US007490614B2

(12) United States Patent
Hayakawa et al.

(10) Patent No.: US 7,490,614 B2
(45) Date of Patent: Feb. 17, 2009

(54) COATING CONTAINER WITH COMB

(75) Inventors: Shigeru Hayakawa, Tokyo (JP); Tsutomu Kobayashi, Ibaraki (JP); Mitsuo Furusawa, Ibaraki (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 226 days.

(21) Appl. No.: 10/502,390

(22) PCT Filed: Jan. 30, 2003

(86) PCT No.: PCT/JP03/00907

§ 371 (c)(1),
(2), (4) Date: Jul. 26, 2004

(87) PCT Pub. No.: WO03/064285

PCT Pub. Date: Aug. 7, 2003

(65) Prior Publication Data

US 2005/0082315 A1 Apr. 21, 2005

(30) Foreign Application Priority Data

Jan. 31, 2002 (JP) ..... 2002-024699

(51) Int. Cl.
*A45D 24/22* (2006.01)

(52) U.S. Cl. ..... 132/112

(58) Field of Classification Search ..... 132/112–116; 401/189, 148; 222/321.7, 321.9, 385
See application file for complete search history.

(56) References Cited

U.S. PATENT DOCUMENTS 3,961,635 A * 6/1976 Miya ..... 132/113
4,056,216 A * 11/1977 Kotuby ..... 222/385
4,322,020 A * 3/1982 Stone ..... 222/95
5,417,258 A * 5/1995 Privas ..... 141/18
5,772,077 A * 6/1998 Tafur ..... 222/192
5,921,444 A * 7/1999 Fuchs ..... 222/321.9
6,000,405 A * 12/1999 De Laforcade ..... 132/116
6,039,204 A 3/2000 Hosokoshiyama et al.
6,168,335 B1 * 1/2001 Mears et al. ..... 401/190
6,260,557 B1 7/2001 Yarbrough (Continued)

FOREIGN PATENT DOCUMENTS

JP U-3021345 2/1996

(Continued)

*Primary Examiner*—Robyn Doan
*Assistant Examiner*—Rachel A Running
(74) *Attorney, Agent, or Firm*—Oliff & Berridge, PLC

(57) ABSTRACT

A comb-carrying container is designed for applying substance by sequential action. The container has a hollow comb with a shaft, and a cap-like member formed at the lower end of the shaft, and a laminated container body consisting of an outer layer and an inner layer peelable therefrom and having an opened neck portion, to which the cap-like member is fitted, such that the liquid in the container may be discharged from the teeth of the comb through the shaft. In the present invention, the shaft 32 and the cap-like member 21 is separated each other, and a pump cylinder 11 is depending from the cap-like member 21 to the laminated container body 1, and a stem 41 is depending from the shaft 32 into the pump cylinder 11. A cylindrical piston 44 is attached at the lower end portion of the stem.

2 Claims, 7 Drawing Sheets

U.S. PATENT DOCUMENTS 6,637,440 B2 * 10/2003 de Laforcade ..... 132/112

FOREIGN PATENT DOCUMENTS

| | | |
|---|---|---|
| JP | A-08-169462 | 7/1996 |
| JP | A 9-030575 | 2/1997 |
| JP | A-11-127944 | 5/1999 |
| JP | A-11-253225 | 9/1999 |
| JP | A 11-267559 | 10/1999 |
| JP | A 2000-41727 | 2/2000 |
| JP | A 2000-62862 | 2/2000 |
| JP | A 2001-146260 | 5/2001 |
| JP | A 2002-46783 | 2/2002 |

* cited by examiner

COATING CONTAINER WITH COMB

TECHNICAL FIELDS

The present invention relates to an a container with comb, or a comb-carrying container for applying substance such as hair-dressing agent.

BACKGROUND

As a type of such application containers, it is well known that the application container comprises a hollow comb having a plurality of teeth with application holes (or discharge holes) for providing an easy application of the hair-dressing agent or the like to user's hair, such as shown in U.S. Pat. No. 6,260,557 for example. A lower portion of the hollow comb is shaped into a mounting cylinder for fitting on the neck portion of its container body.

Besides the comb-carrying application container, it is also known to provide a so-called delamination container for keeping the material at a favorable air tight condition. The delamination container is a laminated bottle consisting of a basic, outer layer and an inner layer which is delaminatable or peelable from the outer layer upon depressurization such as shown in U.S. Pat. No. 6,039,204.

On the basis of these inventions, Japanese Patent Laid-Open No. 2001-146260 provides as shown in FIGS. 7 and 8 of this application, a laminated container 101 consisting of such outer layer 103 and inner layer delaminatable therefrom and having a neck portion, and a hollow comb with a shaft, a lower end portion of which is formed into a cap-like member 102 for fitting on the neck portion of the laminated container. At a bottom portion of the laminated container 101, the outer layer 103 is provided with a small diameter ambient air introduction port 105, such that when the trunk portion of the laminated container is compressed by the user, the liquid in the laminated container is discharged from the teeth of the hollow comb through the interior of its shaft, and when the compression of the trunk portion is released, the outer layer is delaminated from the inner layer to recover its original shape, such that the air is sucked into a space between the inner and outer layers through the ambient air introduction port 105.

In this laminated container, the ambient air introduction port is so small in diameter than its discharge hole as to refrain the air from flowing out therethrough. As a result, when the trunk portion of the laminated container is squeezed for the second time use and thereafter, the air between the inner and outer layers 104, 103 does not escape scarcely from the ambient air introduction hole, so as to ensure an effective compression of the inner layer, only if the user squeezes the laminated container relatively rapidly. On the other hand, this feature means that after the compression of the laminated container is released, it takes some time that the container's outer layer 103 recovers to its original shape, during which the next squeezing operation is unfeasible. Accordingly, the known application container is not suitable for continuous squeezing operation.

Such problem may also be solved, if the laminated container is provided at its desirable portion of the outer layer with a valved ambient air introduction port, i.e. a port having a check valve for refraining unfavorable reverse flow of the air upon compression of the laminated container, such that the ambient air introduction port is formed as a relatively large-diameter hole. As disclosed in Japanese patent Laid-Open No. 2000-41727, such a valved port may be formed at the neck portion of the laminated container and the check valve is provided at a favorable part of the container for shutting off the communication between the ambient air introduction port and the outside of the container upon squeezing its trunk portion. However, since the trunk portion of this container is formed deformable upon squeezing, it has other inconveniences. Firstly, it is difficult to print on the trunk portion, even though it is desired to do so in such a container. Secondly, although the container is also desired to be covered with a shrink from, the film is apt to be wrinkled by squeezing the container.

The aforementioned problems may also arise in another container similar to the previous application container with comb except in that the laminated container having peelable inner layer is replaced by a double container consisting of an inner container compressible upon squeezing and an outer container which is excellent in shape retentivity. The application container is shown in Japanese Laid Open No. 2002-46783 for example.

DISCLOSURE OF THE INVENTION

First purpose of this invention is to provide a comb-carrying container comprising a laminated container body having an inner layer delaminatable from an outer layer, and a pump mechanism for discharging liquid without squeezing its trunk portion, such that it enables rapid discharge action.

For achieving this purpose, an application container with comb according to this invention comprises:

a laminated container body having a neck portion, and including an outer layer and an inner layer delaminatable therefrom; a hollow comb having a shaft and one or plurality of discharge orifice(s); and a cap-like member which is formed at a lower end of the shaft and fitted on the neck portion, such that a liquid in the laminated container body is discharged from the discharge orifice(s) through the shaft, wherein the cap-like member is formed as a separate body from the shaft, and that a pump cylinder is depending from the cap-like member into the laminated container body, and a stem is depending from the shaft into the pump cylinder and having a lower end portion to which a cylindrical piston is provided, the stem and the cylindrical piston being biased upwardly and vertically movably by means of the comb with the shaft, with respect to the laminated container body and the cap-like member.

Furthermore, for achieving the same purpose, the present invention also provides an application container with comb similar to the aforementioned one, except that the laminated container body with the inner layer delaminatable from the outer layer is replaced by a double container body consisting of an outer bottle and an inner bottle which is compressible (or shrinkable) upon depressurization.

Second purpose of the present invention is to provide an application container with comb of the above mentioned type which is easy to operate its pump mechanism and useful in its handling.

For achieving this purpose, the present invention proposes to provide the application container according to the first purpose with a depression rod protruding laterally outwardly from a lower portion of the shaft. The depression rod enables favorable one hand operation of the container, in a way that the user may depress the depression rod with one finger of the hand, while gripping the upper part of the laminated container body by the same hand and combing the hair, without changing the manner of gripping.

Third purpose of the present invention is to provide an application container with comb of the above-mentioned type wherein a stop cylinder for preventing an unintentional escape of the cylindrical piston is inserted into an upper portion of the pump cylinder.

Fourth purpose of the present invention is to provide an application container with comb of the above-mentioned type which is economical and more excellent in easy operation of the pump mechanism.

For achieving this purpose, the present invention proposes the application container with comb according to the first purpose, characterized in that the cap-like member having a peripheral wall, a lower half of which is fitted on the neck portion of the container body (either the laminated container body or the double container body), and an inward flange-like wall protruding from an intermediate portion of the peripheral wall, an inner circumference of the inward flange-like wall is continuously connected to the pump cylinder, and also in that a lower (end) portion of the shaft is radially expanded to define an expanded cylinder which is fitted vertically slidably within an upper half of the peripheral wall, a shoulder portion for depression is formed between the expanded cylinder and the other part of the shaft excluding its lower end portion, and the stem is provided at its upper end portion with an outer flange for fitting to an inner surface of the expanded cylinder liquid-tightly.

Owing to this feature, when the content of the container is running out for example, the container body may be removed from the cap-like member, and then replaced by another new container body for reutilizing the shaft of the comb and the pump-mechanism such that it is economically advantageous. Moreover, it is possible to actuate the pump mechanism by depressing the shoulder portion between the shaft and the expanded cylinder, such that the shaft of the comb is free from any tilting torque, i.e. a torque acting in a direction to tilt or incline the shaft. As a result, a smooth depression of the expanded cylinder is ensured.

A construction externally similar to the aforementioned shoulder portion is disclosed in Japanese Laid Open No. 9-30575 as shown in FIG. 9 of the present application. This document teaches an aerosol container 111 having a stem with a depression head 112, and a comb standing from a front portion of the upper side of the depression head, while a depression portion 113 is formed at a rear portion of the upper side of the same, corresponding to the shoulder portion of the present application. However, the pump-activated container according to the present invention is different from the aerosol container in that it may be necessary to depress the stem repeatedly for several times to discharge the required amount of the liquid. And moreover, the stroke of the stem in the former is larger than that in the latter. Accordingly, the aforementioned pump-activated container is susceptible to a possible tilting torque, causing unfavorable friction which disturbs smooth up-and-down movement of the stem, when such tilting torque is applied to the expanded cylinder sliding within the upper half of the peripheral wall of the cap-like member. In order to prevent such inconveniences, the application container according to the present invention further comprises a spring which is provided between the inner flange-like wall and the outer flange for upwardly biasing the same, such that the elastic force of the spring effectively opposes to an eccentric depression force, i.e. a depression force deviating from the central axis of the container body and acting on the upper side of the shoulder portion. this feature favorably guarantees the smooth up-and-down movement of the expanded cylinder and the cylindrical piston during the actuation of the pump mechanism.

Fifth purpose of the present invention is to provide an application container with comb of the aforementioned type, which is capable of being printed on the trunk portion of the container body in an easy, simple manner, and also free from being wrinkled when the outer surface of its trunk portion is covered by a shrink film.

For achieving this purpose, the present invention proposes, in the application container according to the first purpose, to form the outer layer of the laminated container body or the outer container of the double container by the rigid material to ensure shape retentivity.

Other purposes of the present invention will be explained in the following description.

BEST MODE OF THE INVENTION

Figure 1:
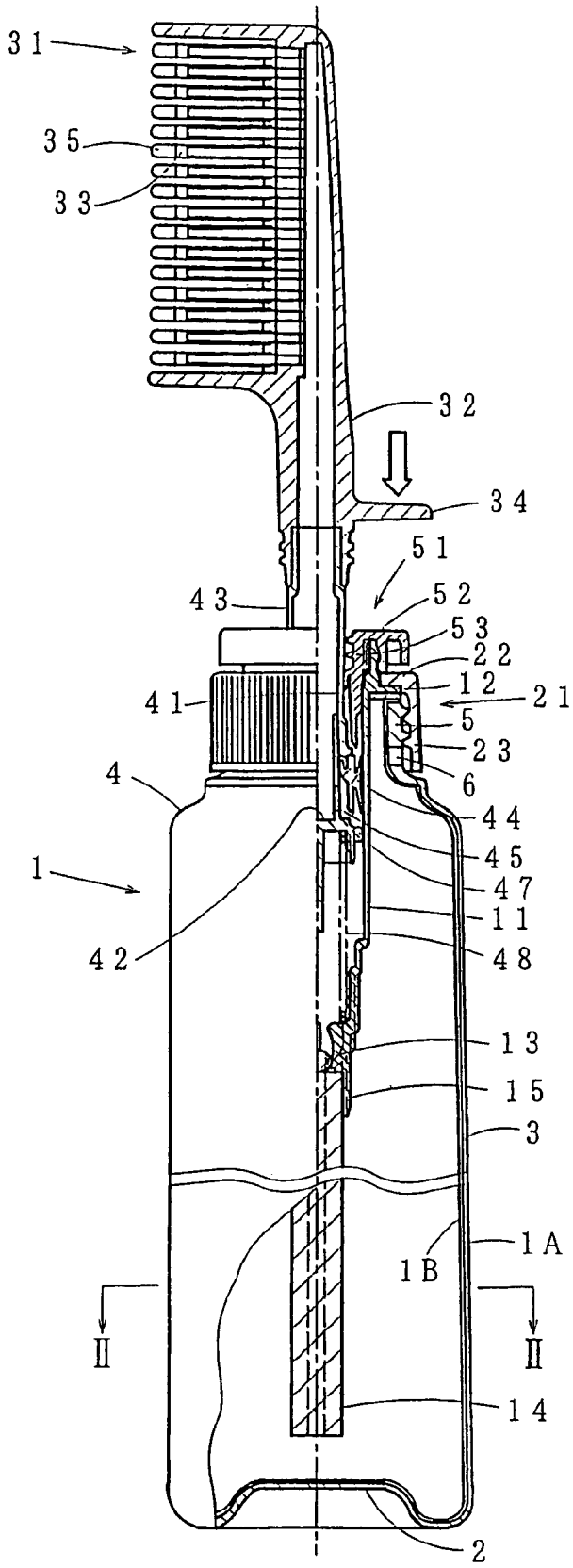
FIG. 1 is a half vertical section view of the application container with comb according to the first embodiment of the present invention.
Figure 2:
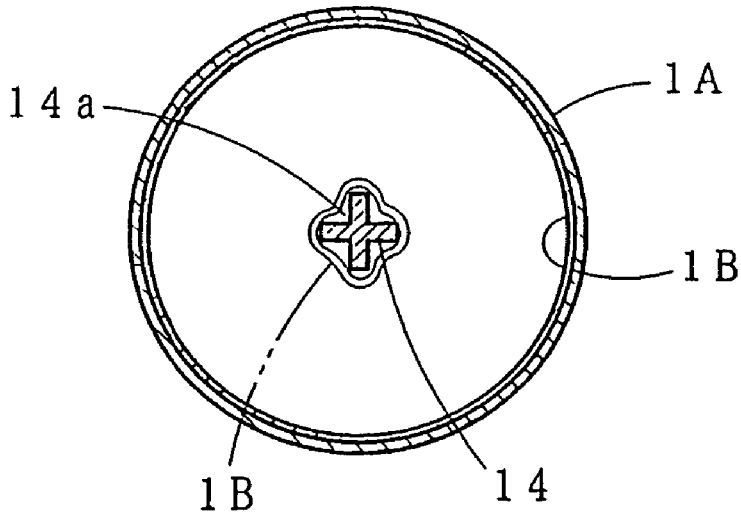
FIG. 2 is a section view of the container taken along II-II line in FIG. 1.

Hereinafter, the best mode of the present invention will be explained according to the attached drawings. FIGS. 1 and 2 show the first embodiment.

Numeral 1 designates a laminated container body having a trunk portion 3, an opened neck portion 5 standing from the top end of the trunk portion, and a shoulder 4 formed therebetween. The neck portion is cylindrical and has outer screw grooves. The laminated container body 1 is made of an outer layer 1A and inner layer 1B which are peelably or delaminatably jointed each other. The outer layer 1A is formed as a stiff layer so as to resist elastic deformation. And on the other hand, an ambient air introduction port 6 is formed at the outer layer 1A in the lower part of the neck portion 5 for introducing air into a gap between the outer and inner layers after the inner layer is peeled off from the outer layer.

A pump cylinder 11 is depending into the laminated container body 1. The pump cylinder is provided at its upper portion with an outward flange 12 for resting on the top face of the laminated container body 1. A suction valve 13 is formed at the lower end of the pump cylinder 11, from which a grooved stick 14 is depending. This grooved stick has a plurality of vertical grooves 14*a* for communicating with the suction valve 13, such that the liquid in the laminated container body 1 is sucked into the pump cylinder 11 through the vertical grooves 14*a* and the suction valve 13.

The outward flange 12 is held by the cap-like member 21 by cramping it between its inner flange 22 of the cap-like member and the top face of the laminated container body 1. The cap-like member 21 has a peripheral wall 23 for screw-fitting on the outside of the neck portion 5 of the laminated container body 1, while the inner flange 22 is provided at the top end of the peripheral wall 23.

An operation member of a known longitudinal pump is depending from the lower end of the hollow comb shaft 32 into the pump cylinder 11 and is fitted therein vertically slidably and biased upwardly. In this type of the longitudinal pump, the operation member may be formed into any construction if it has a cylindrical piston at a lower end of a stem, and a discharge valve at a middle of a liquid passage defined by the stem, and also, a discharge member is fitted on the top of the stem. The discharge member is embodied by the hollow comb 31 with shaft according to this invention. The hollow comb 31 is adapted to move up and down against the upwardly biasing force such that the liquid in the container body is sucked into the pump cylinder 11 through the suction valve 13, and the liquid in the pump cylinder 11 is discharged from a plurality of discharge holes 33 formed in the hollow comb 31 through the discharge valve.

The stem 41 may be formed by upper and lower two members. In the shown embodiment, the stem 41 has a lower stem member 42 with a bottom, and an upper stem member 43 having a lower end portion into which an upper part of the lower stem member 42 is fitted and fixed tightly, while the lower stem member 42 is provided at its lower end with an outer flange 47. A cylindrical piston 44 is fitted vertically slidably on the outside of the lower stem member 42 between the outer flange 47 of the same and the lower end of the upper stem member 43. A discharge valve hole 45 is perforated in the stem 41 above the outer flange 47, such that when the stem 41 is in the lowermost position, the cylindrical piston 44 moves upwardly to open the discharge valve hole 45, and when the stem 41 is in uppermost position, the cylindrical piston 44 moves downwardly to close the discharge valve hole 45.

The hollow comb 31 has the hollow shaft 32, into which the lower end portion of which the upper stem member 43 is fitted tightly at its upper end portion. The lower end portion of the hollow shaft 32 is formed into a screwed cylinder. A depression rod 34 is protruding from the shaft 32 above the screwed cylinder.

Numeral member 51 designates a stop cylinder fitted into the upper end portion of the pump cylinder 11 for preventing an unintentional escape of the operation member. The stop cylinder 51 may also be of any known type. For example, the stop cylinder 51 has a flange-shaped top wall 52 and an inner cylinder 53 depending therefrom for screw-fitting on the outside of the lower end portion of the hollow shaft 32 for holding the hollow comb 31 in a prescribed lowermost portion.

Hereinafter, other embodiments of the present invention are described. In the description, the explanation on the construction substantially similar to that of the first embodiment is omitted, while applying the same numeral to the corresponding element.

Figure 3:
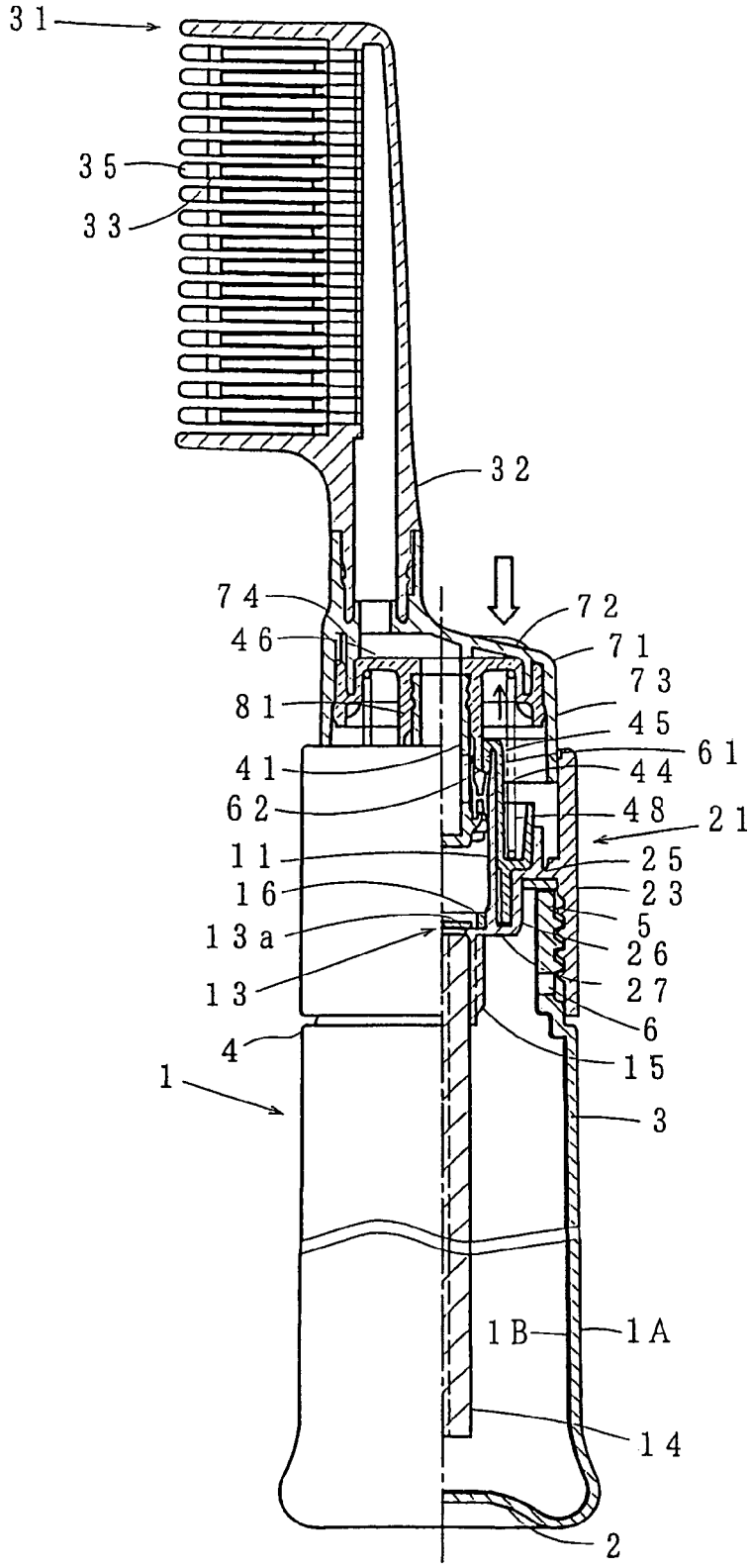
FIG. 3 is a half vertical section view of the application container with comb according to the second embodiment of the present invention.
Figure 4:
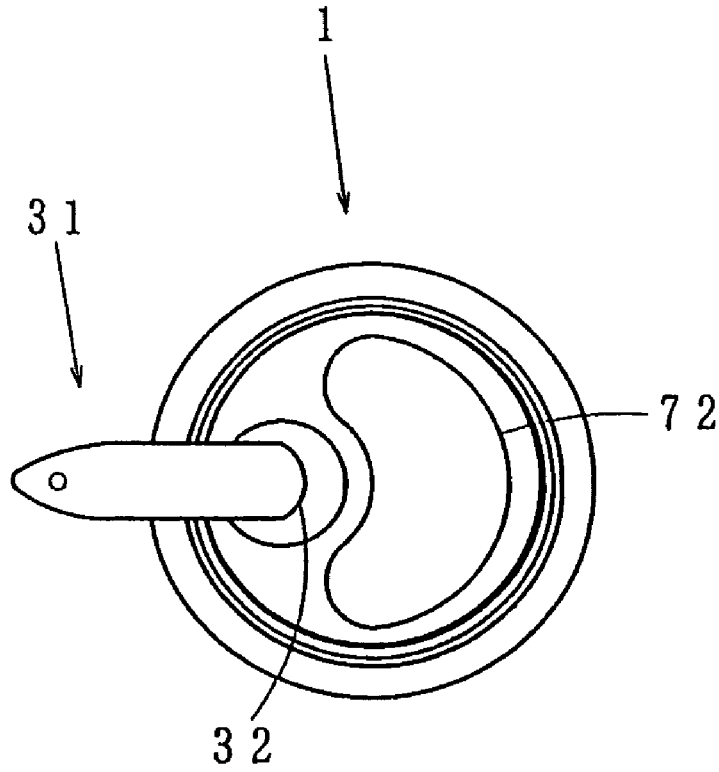
FIG. 4 is a top plan view of the application container shown in FIG. 3.

FIGS. 3 and 4 show a second embodiment, in which the construction of the pump cylinder 11 and the operation member are modified.

The pump cylinder 11 is formed integrally with the cap-like member 21 having a peripheral wall 23 acting as a connection cylinder, the lower half of which is screw-fitted on the neck portion 5 of the laminated container body 1. A first inward flange-like wall 25 is attached at the intermediate portion of the peripheral wall 23, and a second inward flange-like wall 27 is attached at a depending cylinder 26 extending downwardly from an inner periphery of the first inward flange-like wall 25. The pump cylinder 11 is extending upwardly from the radialwise (widthwise) center of the second inward flange-like wall 27. A cylindrical member 61 is fitted on the outside of the pump cylinder 11 and turned back at its upper side to form a turned back cylinder 62 for fitting at the inside of the upper end portion of the pump cylinder 11. Within this pump cylinder 11, the suction valve 13 is formed by a valve hole defined by an inner periphery of the second inward flange-like wall 27, a valve plate 13*a* for closing the upper side of the valve hole, which is connected via a plurality of elastic pieces to a short cylinder 16 fitted to the inner surface of the lower end portion of the pump cylinder 11.

A depression cylinder 71 is formed as a separate body from the hollow shaft 32 of the hollow comb 31 and attached to the lower end of the hollow shaft 32. The depression cylinder 71 is formed by a small-diameter upper portion 74 for fitting to the lower end portion of the hollow shaft 32, a large-diameter lower portion defining an expanded cylinder 73, and a shoulder portion 72 (or an upwardly directed stepped portion) formed therebetween by expanding or swelling outwardly. Within the expanded cylinder 73, the outward flange 46 on the stem 41 is attached. In the shown embodiment, the outward flange 46 is defined by a connecting member having a central hole from which a stem-fitting cylinder 81 is depending, while the stem 41 with a bottom is depending therefrom, and an upper cylindrical portion thereof is fitted into the stem-fitting cylinder 81. A lower portion of the stem 41 is formed into a large external diameter portion, while a portion of the stem-fitting cylinder 81 is formed into a large internal diameter portion, such that the cylindrical piston 44 is fitted vertically slidably on the outside of the stem 41 between these large external diameter portion of the stem 41 and the large internal diameter portion of the stem-fitting cylinder 81. The discharge valve hole 45 bored on the stem 41 is adapted to be opened and closed by the up-and-down movement of the cylindrical piston 44. Moreover, an upwardly biasing spring 48 is arranged between the outward flange 46 (the outer peripheral portion of the outward flange preferably) and the inward flange-like walls 25,27. The spring 48 is formed outside of the pump cylinder 11 without touching with the liquid in the laminated container body 1 and the pump cylinder 11, so that the material of the spring 48 may he chosen regardless of reactability to the liquid.

For using the container according to the second embodiment, the upper side of the shoulder portion 72 is to be depressed against the upwardly biasing force of the spring 48. In this structure, the smooth descent of the depression cylinder 71 is achieved upon depression of the shoulder portion 72. This is because, although the depression force toward the shoulder portion 72 acts on a location deviating from the central axis of the laminated container body 1 as shown by a white arrow in FIG. 3, the elastic force of the spring 48 opposes the depression force by acting principally from a side below the location of application of the depression force, such that an unfavorable tilting torque is restricted. By depressing the depression cylinder 71, the stem 41 and etc. are depressed at the beginning, while the cylindrical piston 44 remaining in a stationary state, and then the cylindrical piston 44 is depressed together by the lower end of the stem fitting cylinder 81, such that the pump cylinder 11 is pressurized to lead the liquid therein through the discharge valve hole 45, the stem 41, the hollow shaft 32 to the discharge hole(s) 33 perforated in each tooth 35. On the other side, by releasing the depression of the shoulder portion 72, the stem 41 and etc. are upwardly pressed initially by the upwardly biasing force of the spring 48 to let the cylindrical piston 44 to close the discharge valve hole 45, and then the cylindrical piston 44 is moved together with other element so as to depressurize the interior of the pump cylinder 11. And after the depressurization, the liquid in the laminated container body 1 is sucked into the pump cylinder 11 through the vertical grooves 14*a* of the grooved stick 14 and suction valve 13.

Figure 5:
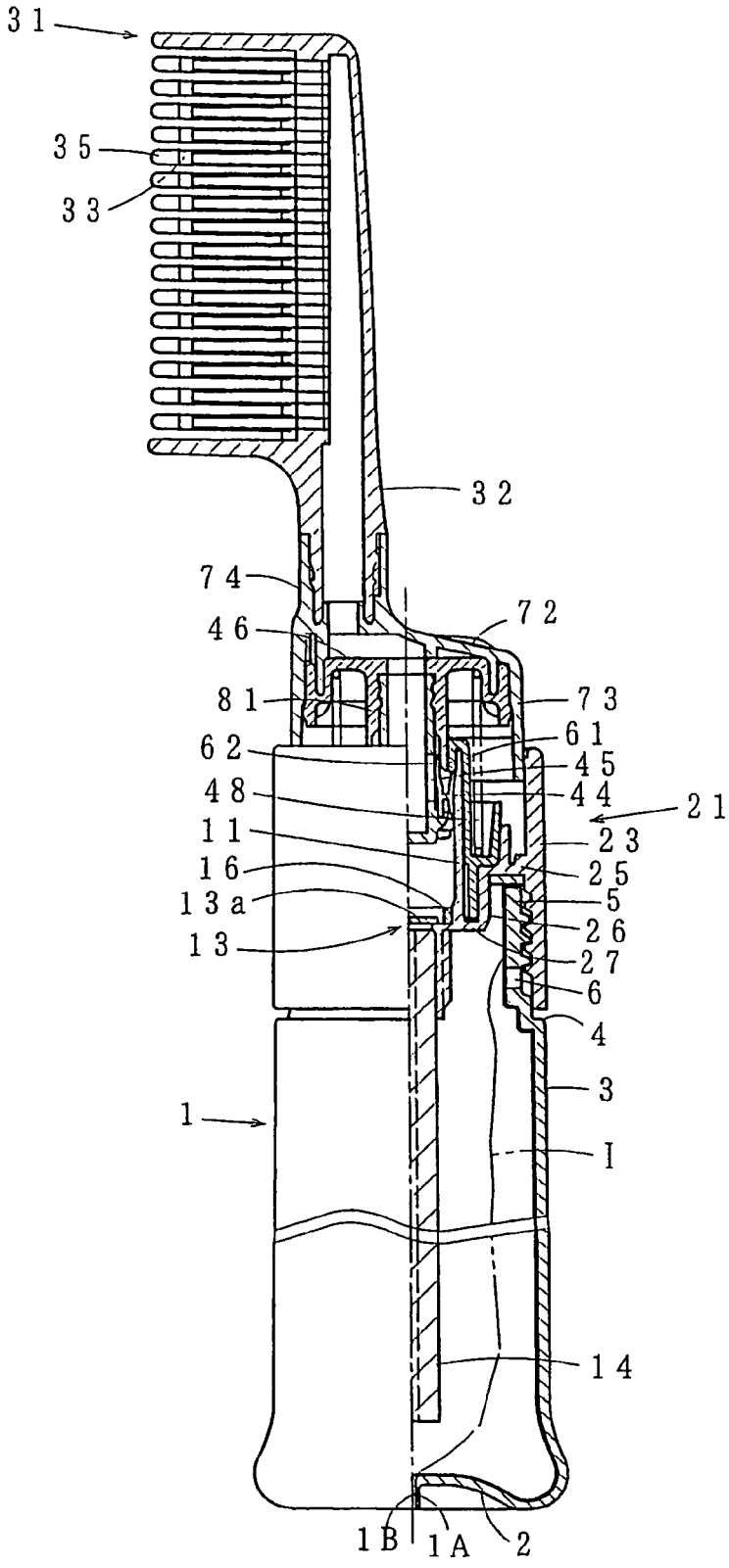
FIG. 5 is a half sectional view of the modified embodiment of the application container shown in FIG. 3.

FIG. 5 shows a modified embodiment of the second embodiment, in which a bottom wall 2 of the laminated container body 1 is divided into two (left and right) parts. In a partition line of the bottom wall, the both ends of the inner layers 1B, 1B are cramped between the both ends of both outer layers 1A, 1A, such that when the interior of the laminated container body 1 is depressurized by the pump action, both lower ends of the inner layers 1B, 1B are prevented from being pulled into the laminated container. This construction is favorable in sucking all of the liquid in the liner layers 1B, 1B into the pump cylinder 11.

Figure 6:
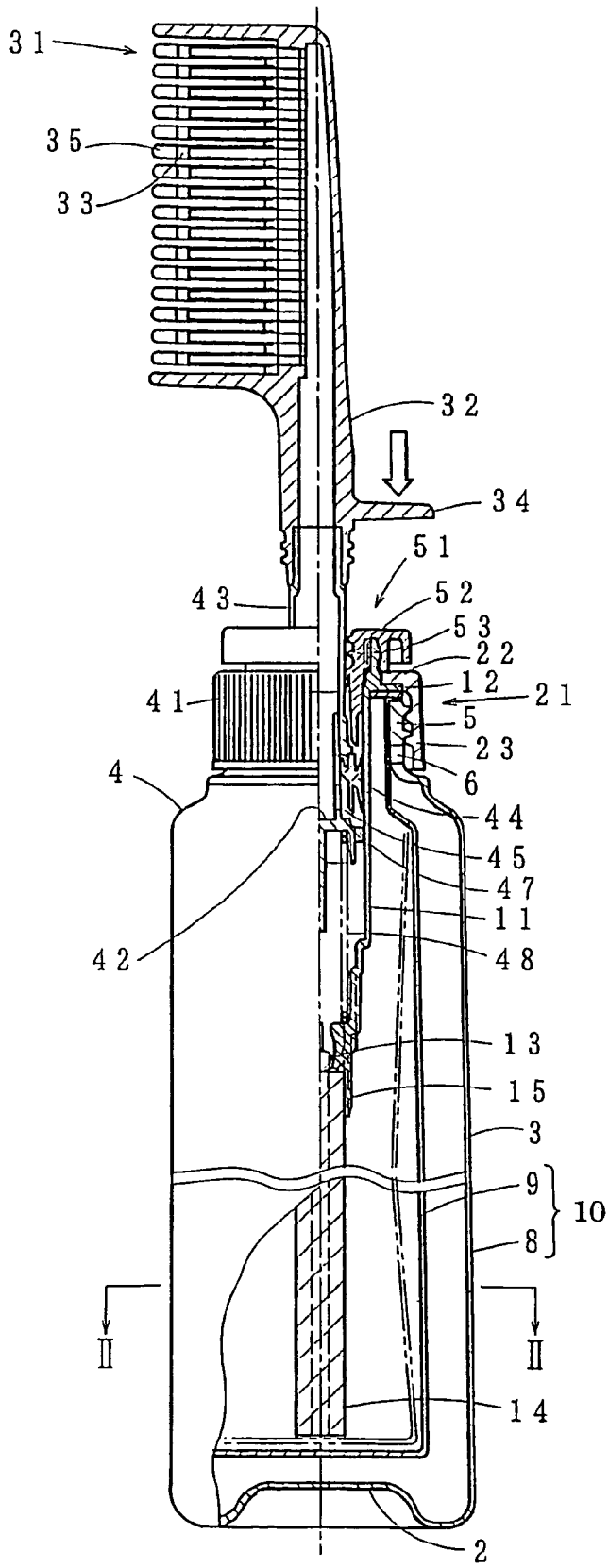
Figure 7:
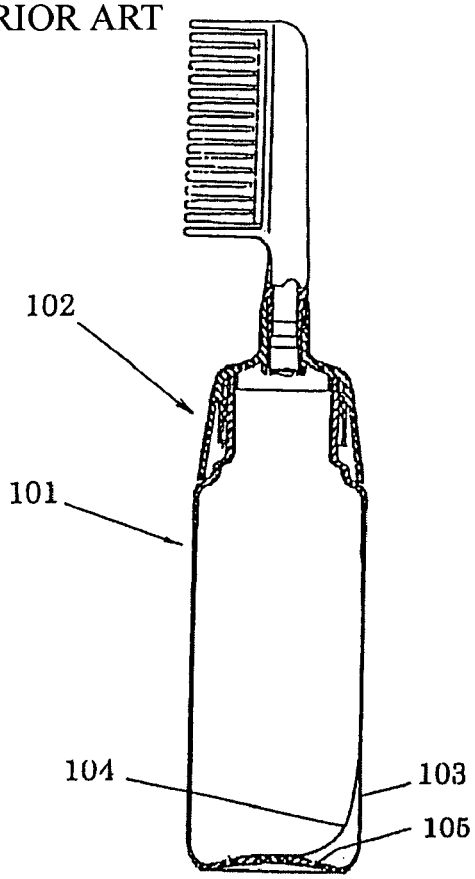
Fig. 7 PRIOR ART
FIG. 7 is a sectional view of a prior art application container with comb.
Figure 9:
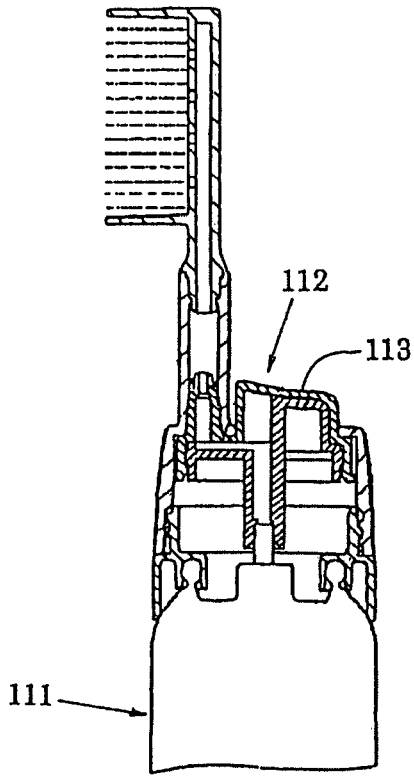
Fig. 9 PRIOR ART
FIG. 9 is an another prior art application container with comb.
Figure 8:
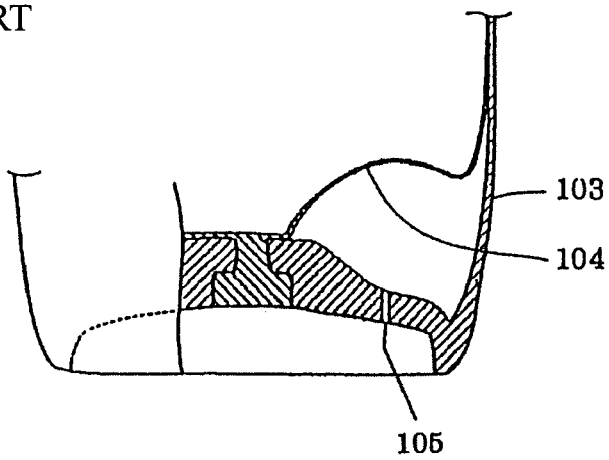
Fig. 8 PRIOR ART
FIG. 8 is an enlarged section of the essential part of the prior art application container shown in FIG. 7.

FIG. 6 shows a third embodiment of the present invention, in which the laminated container body 1 in the first embodiment is replaced by a double container body 10 formed by an outer container (or an outer bottle) 8 and an inner container (or an inner bottle) 9.

The outer container 8 includes a trunk portion 3, a neck portion 5 extending upwardly from the top end of the trunk portion 3, and a shoulder formed therebetween. The neck portion 5 is fitted into the inside of the peripheral wall 23 of the cap-like member 21. Moreover, the ambient air introduction port 6 is perforated at the neck portion 5 as disclosed in previous embodiment. Of course, the construction of the ambient air introduction port 6 may be changed in any favorable manner, and it may be a groove formed on the top end of the neck portion extending radially, for example. Moreover, the outer container 8 may be excellent in shape rententivity.

The inner container 9 has a neck portion fitted into the neck portion 6 of the outer container 8, and is depending therefrom into the trunk portion 3 of the outer container. The pump cylinder 11 is depending into the inner container 9. A space is formed between the trunk portion 3 of the outer container 8 and that of the inner container 9. And moreover, the trunk portion of the inner container 9 is formed compressible, capable of decreasing in its capacity upon depressurization therein.

Furthermore, the laminated container body 1 of the second embodiment may be replaced by the double container body 10 formed by the inner and outer containers in FIG. 6, although such embodiment is not shown in the drawing.

The invention claimed is:

1. A container with a comb for applying a substance, the container with a comb comprising:

a laminated container body having a neck portion, and including an outer layer and an inner layer jointed each other, the inner layer being delaminatable from the outer layer;

a hollow comb having a shaft and one or more discharge orifices;

a cap member formed at a lower end of the shaft and fitted on the neck portion of the laminated container body, such that a liquid in the laminated container body is discharged from the one or more discharge orifices, wherein the cap member is formed as a separate body from the shaft;

a pump cylinder extending from the cap member into the laminated container body;

a stem extending from the shaft into the pump cylinder, the stem having a lower end portion to which a cylindrical piston is provided, the stem, the cylindrical piston, and the comb being biased upwardly and being vertically movable with respect to the laminated container body and the cap member;

a shoulder portion for depressing the stem, the cylindrical piston and the comb, the cap member having a peripheral wall, a lower half of the peripheral wall being screw-fitted on the neck portion of the laminated container body, and an inward flange protruding from an intermediate portion of the peripheral wall, an inner circumference of the inward flange being continuously connected to the pump cylinder in a way that the pump cylinder extends upward from the inner circumference, a lower end portion of the shaft that expands radially outward to define an expanded cylinder that is fitted vertically slidably within an upper half of the peripheral wall, and a grooved stick extending downwardly from the pump cylinder and having a vertical groove, the shoulder portion for depressing that is formed between the expanded cylinder and other portions of the shaft excluding its lower portion, the stem being provided at its upper end portion with an outer flange for fitting to an inner surface of the expanded cylinder, and a spring for upwardly biasing the outer flange, the spring being between the outer flange and the inward flange.

2. The container for applying substance according to claim 1, wherein the outer layer of the laminated container is a shape retentive, stiff layer.

* * * * *